US005499466A

United States Patent [19]

House

[11] Patent Number: 5,499,466

[45] Date of Patent: Mar. 19, 1996

[54] METHOD AND APPARATUS FOR MONITORING GARMENT USAGE

[76] Inventor: Thomas A. House, 1032 Irving St., San Francisco, Calif. 94122

[21] Appl. No.: 272,838

[22] Filed: Jul. 11, 1994

Related U.S. Application Data

[63] Continuation-in-part of Ser. No. 60,015, May 10, 1993, abandoned.

[51] Int. Cl.[6] ..... G09F 3/00

[52] U.S. Cl. ..... 40/322; D6/328

[58] Field of Search ..... 40/322, 657, 663; 283/55, 74, 79, 80; D6/316, 328

[56] References Cited

U.S. PATENT DOCUMENTS

| | | | |
|---|---|---|---|
| 922,948 | 5/1909 | Portmore . | |
| 1,796,894 | 3/1931 | Pendergast . | |
| 2,077,251 | 4/1937 | Moore | 40/322 |
| 3,124,284 | 3/1964 | Collum | 40/322 |
| 3,535,808 | 10/1970 | Morrish | 40/322 |
| 4,756,104 | 7/1988 | Bailey | 40/322 |
| 4,886,010 | 12/1989 | Stutzman . | |

FOREIGN PATENT DOCUMENTS

| | | |
|---|---|---|
| 895390 | 1/1945 | France . |

*Primary Examiner*—Brian K. Green
*Attorney, Agent, or Firm*—Limbach & Limbach

[57] ABSTRACT

Method and apparatus for monitoring the usage of a garment. The subject apparatus comprises a garment monitoring tag with indicator numerals and apparatus for attaching the garment monitoring tag to a garment hanger. The subject methods involve the use of the subject apparatus having numerical indicia corresponding to the number of times a garment has been used.

18 Claims, 3 Drawing Sheets

METHOD AND APPARATUS FOR MONITORING GARMENT USAGE

RELATED U.S. APPLICATION DATA

The present application is a continuation-in-part application of Ser. No. 08/060,015, May 10, 1993, now abandoned.

FIELD OF THE INVENTION

The subject invention is in the field of the mechanical arts, in particular, apparatus and methods for use in conjunction with garments.

BACKGROUND OF THE INVENTION

High quality garments such as suits and dresses require expensive dry cleaning or other similar cleaning methods in order to be properly maintained. Most consumers find it too expensive to send their clothing to the dry cleaners after every use. Therefore, most consumers wear a garment several times before sending it to a professional cleaning service. The problem with this procedure arises when individuals lose count of the number of times their garments have been worn between cleanings. If a garment is worn only a few times between cleanings, money is unnecessarily spent on unneeded cleaning. On the other hand, a garment worn too many times between cleanings may become permanently soiled or excessively worn. It is thus of interest to provide an apparatus and methods for monitoring the number of times a garment has been worn between cleanings. The subject invention provides a novel, inexpensive apparatus for monitoring the number of times a garment has been worn between cleanings.

SUMMARY OF THE INVENTION

The present invention provides an apparatus and methods for monitoring the usage of a garment. The subject apparatus comprises a garment monitoring tag having two major surfaces, wherein each major surface bears a different indicator numeral and is attached to a garment hanger. The subject methods comprise steps by which the garment monitoring tags are implemented to inform the person inspecting the garment the number of times the garment has been used.

DESCRIPTION OF THE SPECIFIC EMBODIMENTS

The subject invention provides an apparatus for monitoring the usage of a garment.

Figure 1A:
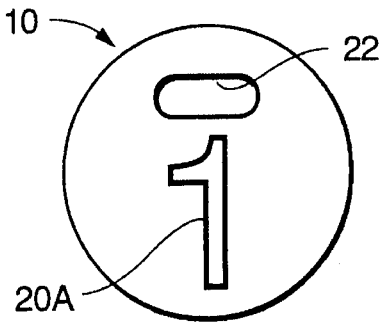
FIG. 1 is a plan view of an example of a garment monitoring tag in accordance with the present invention.
FIG. 1B is a bottom view of the garment monitoring tag in FIG. 1A.
FIG. 1C is a side view of the garment monitoring tag shown in 1A and FIG. 1B.
Figure 1B:
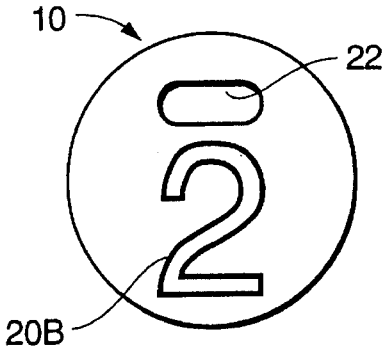
Figure 1C:
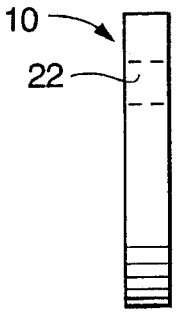
Figure 2:
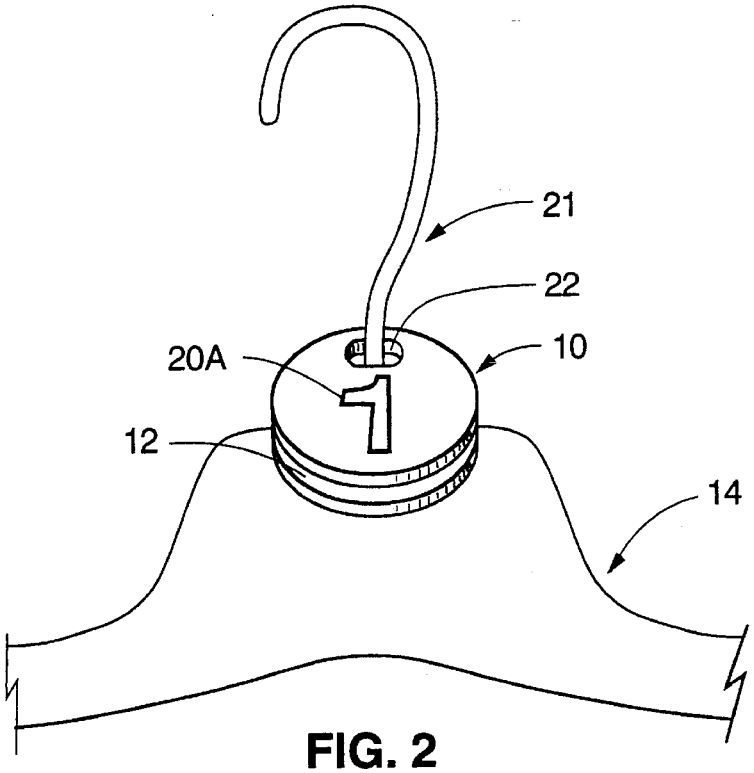
FIG. 2 is a perspective view of the garment monitoring tag in FIG. 1A–1C as mounted on a garment hanger hook and with the top of the garment monitoring tag being visible.
Figure 3A:
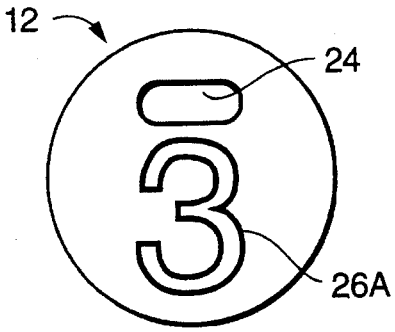
FIG. 3A is a plan view of another example of a garment monitoring tag in accordance with the present invention.
Figure 3B:
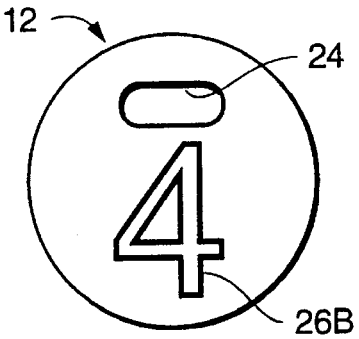
FIG. 3B is a bottom view of the garment monitoring tag shown in FIG. 3A.
Figure 3C:
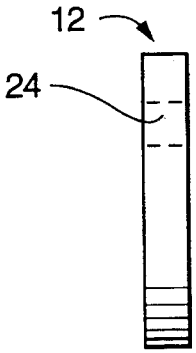
FIG. 3C is a side view of the garment monitoring tag shown in FIG. 3A and 3B.

The subject apparatus (a possible embodiment of which is shown in FIG. 1A, FIG. 1B, and FIG. 1C) comprises a garment monitoring tag having an indicator numeral 20A on at least one of the two major surfaces and a means for attaching the garment monitoring tag to a hanger 14 in FIG. 2. An indicator numeral may be present on each of the two major surfaces. The indicator numerals may be the same or different 20A and 20B from one another. Preferably, the indicator numerals 20A and 20B differ by 1. The garment monitoring tag's outer contour may take the form of a variety of shapes, for example, circles (as shown in FIGS. 1A–1C), ovals, squares, pentagons, hexagons, octagons, or other irregular shapes. The garment monitoring tag may be in a variety of sizes, preferably in the range of 0.3–6 square inches, and more preferably in the range of 0.5–3 square inches. Further, the tags are preferably relatively thin, no thicker than 0.25 inches. As will be explained, relatively thin tags permits a plurality of the tags to be secured to a hanger at one time. Further, thin tags can be more easily packaged in blister type packaging and the like. The garment monitoring tag also includes a means for attachment to a garment hanger 14. The means may take on a variety of forms such as hooks, adhesives, Velcro™, and the like. In a preferred embodiment, the means for attaching the garment monitoring tag to a garment hanger 14 is a through-hole 22 contained within the garment monitoring tag, where the through-hole 22 is of a size sufficient to slide over the garment hanger hook 21 so that a plurality of tags rest on the hanger. Thus, when a through-hole 22 is the attaching means, the garment monitoring tag may be slipped over the garment hanger hook as shown in FIG. 2, and held in place by the garment hanger 14. Embodiments of the garment monitoring tag having a through-hole or aperture 22 as the attaching means may be positioned on a garment hanger 14 in one of two basic positions, i.e., the garment monitoring tag may be placed either face up as in FIG. 1A or face down as in FIG. 1B over the garment hanger hook 21, so as to display a different indicator numeral to someone viewing the garment hanger.

Preferably, at least two separate tags are used, including a first tag bearing numerals "1" and "2" on opposite sides thereof and a second tag bearing numerals "3" and "4" on opposite sides. Thus, it is possible to arrange the two tags on a hanger so that numerals "1" though "4" can be displayed thereby indicating that the garment has be used one, two, three or four times. Additional tags can be added, having numerals that continue the sequence of the first two tags, if usage greater than four times is desired. Preferably, all of the tags are mounted on the hanger at one time so that none of the tags are misplaced. The tag having the appropriate numeral is positioned at the top so that the appropriate numeral is exposed.

In another embodiment, the garment monitoring tag may be implemented to simulate the appearance of the actual garment type undergoing monitoring. The appearance may be simulated by virtue of the contour of the tag, by virtue of an illustration such as a line drawing on the tag, or by both the contour and the illustration.

Figure 4A:
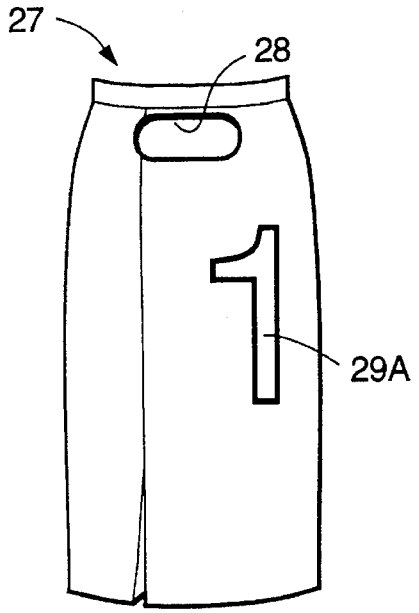
FIG. 4A is a plan view of a contoured garment monitoring tag which simulates the appearance of a garment, namely a women's skirt, in accordance with another embodiment of the present invention.
Figure 4B:
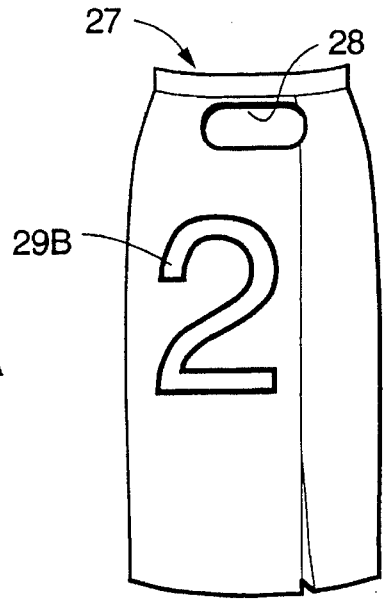
FIG. 4B is a bottom view of the contoured garment monitoring tag shown in FIG. 4A.
Figure 4C:
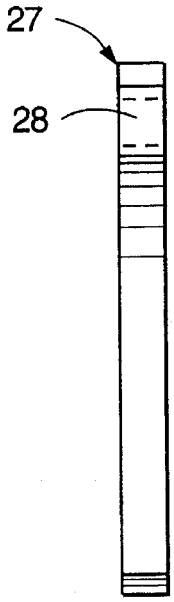
FIG. 4C is a side view of the contoured garment monitoring tag shown in FIG. 4A and 4B.
Figure 5A:
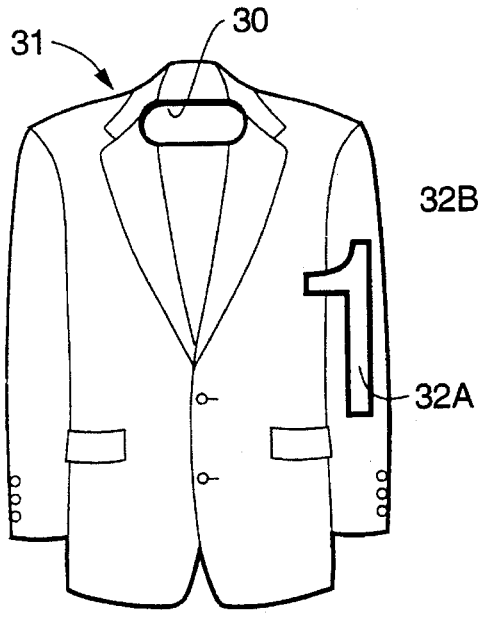
FIG. 5A is a plan view of a further example of a contoured garment monitoring tag which simulates the appearance of a garment, namely a jacket or blazer.
Figure 5B:
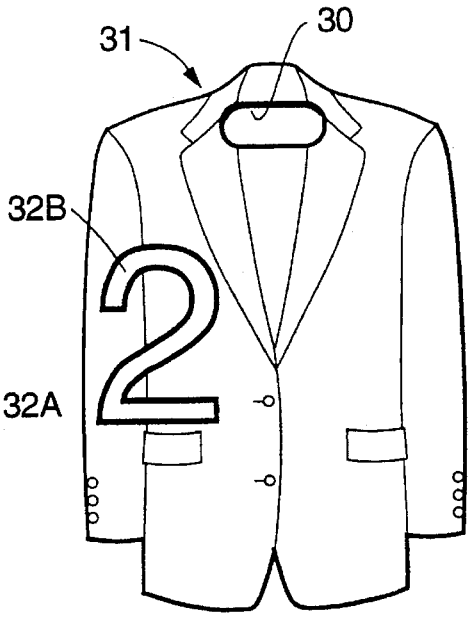
FIG. 5B is a bottom view of the contoured garment monitoring tag shown in FIG. 5A.
Figure 5C:
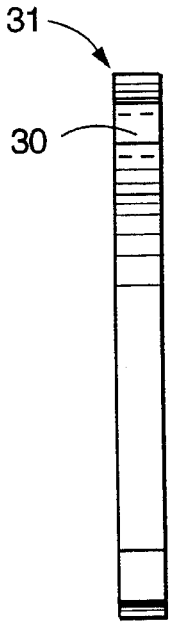
FIG. 5C is a side view of the contoured garment monitoring tag shown in FIG. 5A and 5B.
Figure 6A:
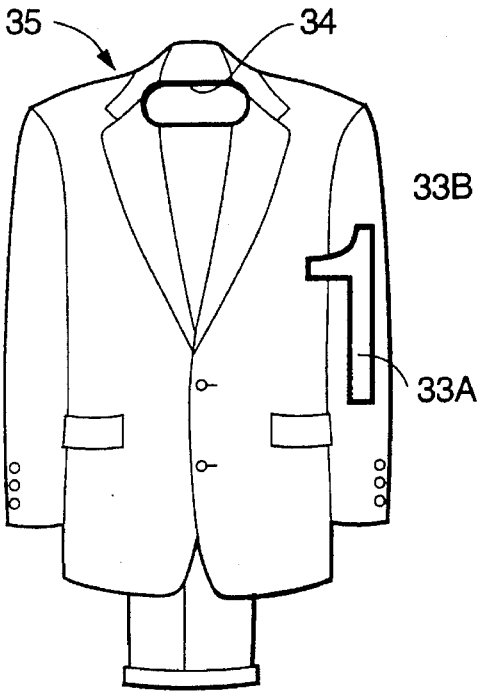
FIG. 6A is a plan view of still another example of a garment monitoring tag which simulates the appearance of a garment, namely, a suit.
Figure 6B:
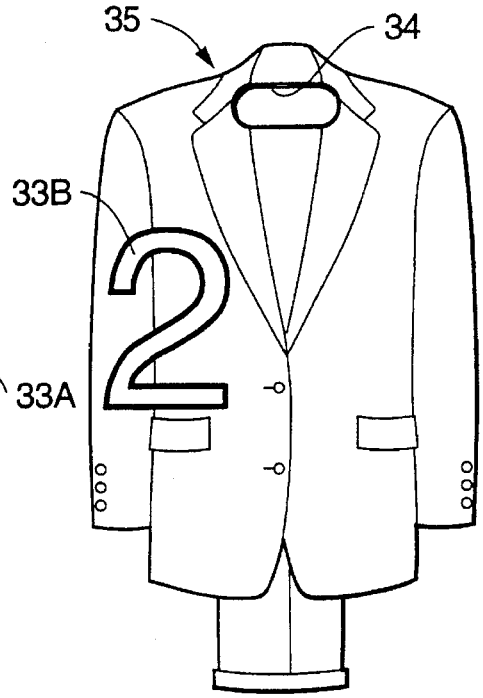
FIG. 6B is a bottom view of the contoured garment monitoring tag shown in FIG. 6A.
Figure 6C:
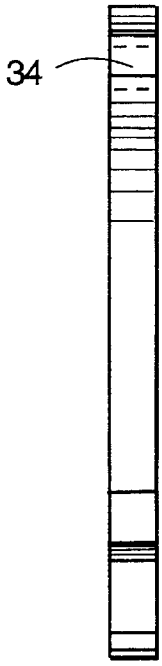
FIG. 6C is a side view of the contoured garment monitoring tag shown in FIG. 6A and 6B.
Figure 7A:
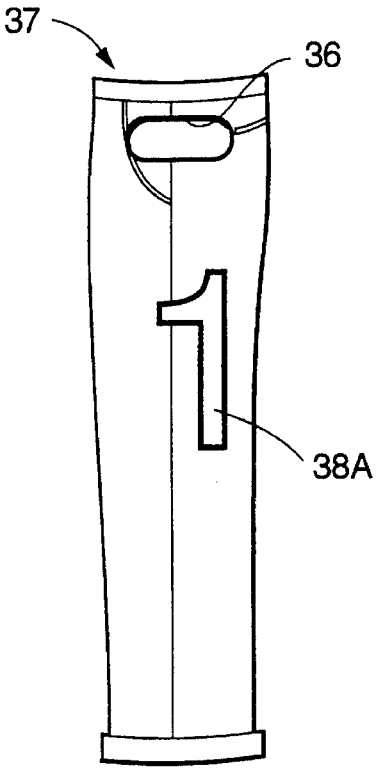
FIG. 7A is a plan view of a still further example of a contoured garment monitoring tag which simulates the appearance of a garment, namely, a pair of pants.
Figure 7B:
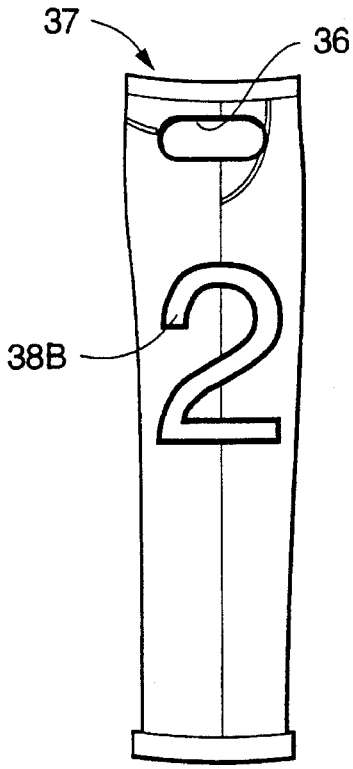
FIG. 7B is a bottom view of the contoured garment monitoring tag shown in FIG. 7A.
Figure 7C:
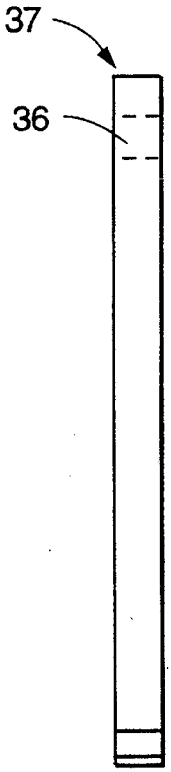
FIG. 7C is a side view of the contoured garment monitoring tag shown in FIG. 7A and 7B.

For example, the tags can be implemented to simulate the appearance of a women's skirt 27 as in FIG. 4, a jacket 31 as in FIG. 5, a suit 35 as in FIG. 6, or a pair of pants 37 as in FIG. 7. In a preferred embodiment, both sides of the garment monitoring tags contain different indicator numerals 29A and 29B, as shown in FIG. 4, 32A and 32B as shown in FIG. 5., 33A and 33B as shown in FIG. 6, and 38A and 38B as shown in FIG. 7. As previously noted, the surfaces preferably bear an illustration so that, in conjunction with the outer contour, the garment monitoring tag more accurately simulates the appearance of the article being monitored. Also preferably, through-holes 28, 30, 34 and 36 are located and sized in such a manner relative to the tag's center of gravity so that the garment monitoring tag is automatically oriented correctly so as to facilitate its recognition when attached to the garment hanger 14 in FIG. 2.

The garment monitoring tag may be made from a variety of materials including paper, leather, plastic, wood, stone, and the like. The method of manufacture will vary in accordance with the material used to create the subject apparatus, so that the method for manufacture is suitable for the material used. For example, when the garment monitoring tag is plastic, it may be produced by injection molding; however, when the subject apparatus is paper or leather, it may be made by die stamping.

The indicator numerals may be marked on either or both major surfaces of the garment monitoring tag using a method suitable to the materials used. For example, printing indicator numerals on the major surfaces could be performed when the tag is constructed from paper, or the indicator numerals may be incorporated into a die mold when the garment monitoring tag is made of plastic.

Another aspect of the subject invention is to provide methods of monitoring the usage of a garment. The subject methods involve the use of the garment monitoring tag, wherein the tag bears an indicator numeral corresponding to the number of times a garment has been previously used. In the subject method of monitoring garment usage, the garment monitoring tag is positioned on a garment hanger so that the indicator numeral corresponding to the number of the times a garment has been used is visible to the person viewing the garment hanger.

An example of the subject methods is as follows. A garment is placed on a garment hanger after having been worn a single time subsequent to cleaning. A plurality of garment monitoring tags 10 and 12, having sequential numerals, are positioned over the hook of the hanger, with the surface of the tag having the numeral "1" being exposed so that it may be viewed by the user. The garment is then worn a second time and, when the garment is returned to the hanger, the upper tag is reversed to display the numeral "2". At a later date, the viewer can simply observe the tag and ascertain that the garment has been worn twice. If the garment is worn a third time, the tags are repositioned on the hanger so that the surface of the tag bearing the numeral "3" is exposed. Preferably, all of the tags remain positioned on the hanger so that they will not be misplaced.

This process is continued until the user ascertains that the garment should be cleaned. Once the cleaning has occurred, the process can be repeated as required. Preferably, the tags are sold as kits containing at least two tags with sequential numerals and a set of printed instructions.

EQUIVALENTS

The foregoing written specification is considered to be sufficient to enable one skilled in the art to practice the invention. Various modifications of the described modes for carrying out the invention which are obvious to those skilled in the relevant field of technology are intended to be within the scope of the following claims.

What is claimed is:

1. An apparatus for monitoring the usage of a garment, the apparatus comprising:

a garment hanger, wherein the garment hanger includes a garment hanger hook;

a first garment monitoring tag having a thickness of less than 0.25 inches and including a first major surface and a second major surface, with the first and second surfaces of the first garment monitoring tag bearing sequential indicator numerals;

a second garment monitoring tag having a thickness of less than 0.25 inches and including a first major surface and a second major surface, with the first and second surfaces of the second garment monitoring tag bearing sequential indicator numerals which differ from the indicator numerals of the first garment monitoring tag;

a means for attaching the first garment monitoring tag to the garment hanger; and a means for attaching the second garment monitoring tag to the garment hanger.

2. The apparatus according to claim 1, wherein the means for attaching includes a portion of the first and second tags which defines a through-hole formed in each of the tags through which the hook of the hanger passes.

3. The apparatus of claim 2 wherein the tags have a center of gravity and the through-hole is positioned on the tags relative to the center of gravity so that the numerals are displayed vertically.

4. An apparatus according to claim 3, wherein the first major surface and the second major surface of the first and second tags form a circular shape.

5. The apparatus of claim 3 wherein the tags have a tag profile which simulates an appearance of a type of garment.

6. The apparatus of claim 5 wherein the tags have illustrations on the first and second major surfaces which simulate a type of garment which is a same type as simulated by the tag profile.

7. An apparatus for monitoring the usage of a garment, the apparatus comprising:

a garment hanger, wherein the garment hanger includes a garment hanger hook;

a plurality of garment monitoring tags, each of the tags including a first major surface and a second major surface, wherein the first major surface bears a first numerical indicator and the second major surface bears a second numerical indicator, wherein the first major surface and the second major surface form a circular shape; wherein the numerical indicators of all of the tags are sequential; wherein the tags have a thickness which does not exceed 0.25 inches; and wherein each of the tags defines an opening which receives the hanger hook so that the tags are disposed on the hanger in a stacked arrangement.

8. The apparatus of claim 7 wherein the tags have an outer contour which simulate an appearance of a suit.

9. The apparatus of claim 8 wherein the first and second major surfaces of the tags bear an illustration of a suit.

10. The apparatus of claim 7 wherein the tags have an outer contour which simulates an appearance of a blazer.

11. The apparatus of claim 10 wherein the first and second major surfaces of the tags bear an illustration of a blazer.

12. The apparatus of claim 7 wherein the tags have an outer contour which simulates an appearance of a pair of pants.

13. The apparatus of claim 12 wherein the first and second major surfaces of the tags bear an illustration of a pair of pants.

14. The apparatus of claim 13 wherein the tags have an outer contour which simulates an appearance of a women's skirt.

15. The apparatus of claim 14 wherein the first and second major surfaces of the tags bear an illustration of a woman's skirt.

16. A method of monitoring the usage of a garment, the method comprising the steps of:

providing first and second garment monitoring tags, with each of the tags including first and second major surfaces, with the first surface of the first tag bearing the numerical indicator for "1", with the second surface of the first tag bearing the numerical indicator for "2", with the first surface of the second tag bearing the numerical indicator for "3", and with the second surface of the second tag bearing the numerical indicator for "4", each of the tags having an opening formed therethrough;

placing a garment, the usage of which is to be monitored, on a garment hanger, with the garment hanger including a hanger hook for supporting the hanger;

positioning the first and second monitoring tags on the hanger by inserting the hanger hook through the tag openings, with the tags being positioned in a stacked arrangement with the numeral "1" exposed for viewing;

removing the garment from the hanger for use;

repositioning the tags on the hanger so that the numeral "2" is exposed for viewing;

removing the garment from the hanger for use;

repositioning the tags on the hanger so that the numeral "3" is exposed for viewing;

removing the garment from the hanger for use;

repositioning the tags on the hanger so that the numeral "4" is exposed for viewing.

17. The method according to claim 16, wherein the tags are configured to simulate an appearance of the garment being monitored.

18. The method according to claim 17 wherein the tags have a thickness of less than 0.25 inches.

* * * * *